United States Patent [19]

Abendroth

[11] Patent Number: 4,930,280

[45] Date of Patent: Jun. 5, 1990

[54] FLOORING SYSTEM WITH METAL STRIPS

[75] Inventor: Thomas W. Abendroth, Mercer, Wis.

[73] Assignee: Abendroth Corullo Stephenson, Inc., Mercer, Wis.

[21] Appl. No.: 410,853

[22] Filed: Sep. 22, 1989

[51] Int. Cl.[5] ..... E04B 1/62

[52] U.S. Cl. ..... 52/403; 52/408; 52/480

[58] Field of Search ..... 52/364, 393, 403, 480, 52/376, 368, 377, 408, 366, 369, 370

[56] References Cited

U.S. PATENT DOCUMENTS 4,449,342 5/1984 Abendroth ..... 52/393

4,644,720 2/1987 Schneider ..... 52/403 X 4,682,459 7/1987 Stephenson ..... 52/393 X 4,759,164 7/1988 Abendroth et al. ..... 52/403

*Primary Examiner*—Carl D. Friedman

*Assistant Examiner*—Creighton Smith

*Attorney, Agent, or Firm*—Michael, Best & Friedrich

[57] ABSTRACT

Disclosed herein is a flooring system adapted to be laid on a rigid supporting slab, which system comprises an understructure resting on the supporting slab, and a floating floor assembly comprising a series of parallel and spaced apart steel strips resting on the understructure, a layer of plywood on the steel strips, a series of floor boards in abutting parallel relation to each other, extending transversely to the steel strips, and located on the plywood layer, and a plurality of fasteners extending through the floor boards, through the plywood layer, and through the steel strips.

22 Claims, 2 Drawing Sheets

FLOORING SYSTEM WITH METAL STRIPS

BACKGROUND OF THE INVENTION

1. Field of the Invention

The invention relates generally to flooring systems for gymnasiums and the like.

2. Reference to Prior Art

Attention is directed to the following United States Patents:

| | | |
|---|---|---|
| 1,828,842 | J. F. Loucks | October 27, 1931 |
| 2,573,482 | P. G. Peik | October 30, 1951 |
| 2,605,867 | G. I. Goodwin | August 5, 1952 |
| 2,950,789 | Davis, et al. | August 30, 1960 |
| 3,164,227 | Davis, et al. | January 5, 1965 |
| 3,473,281 | R. E. Omholt | October 21, 1969 |
| 3,979,867 | Sowinski | September 14, 1976 |
| 3,566,569 | Coke, et al. | March 2, 1971 |
| 4,526,418 | Martin | July 2, 1985 |

SUMMARY OF THE INVENTION

The invention provides a flooring system adapted to be laid on a rigid supporting slab, which system comprises an understructure resting on the supporting slab, and a floating floor assembly comprising a series of parallel and spaced apart steel strips resting on the understructure, a layer of plywood on the steel strips, a series of floor boards in abutting parallel relation to each other, extending transversely to the steel strips, and located on the plywood layer, and a plurality of fasteners extending through the floor boards, through the plywood layer, and through the steel strips.

The invention also provides a flooring system adapted to be laid on a rigid supporting slab, which system comprises a first layer of plywood in adjacent relation to the supporting slab, a series of parallel and spaced apart steel strips on the first plywood layer, a second layer of plywood on the steel strips, a series of floor boards in abutting parallel relation to each other, extending transversely to the steel strips, and located on the second plywood layer, and a plurality of fasteners extending through the floor boards, through the second plywood layer, and through the steel strips.

The invention also provides a flooring system adapted to be laid on a rigid supporting slab, the system comprising a series of sleepers in parallel spaced relation to one another and in adjacent relation to the supporting slab, a like series of parallel and spaced apart steel strips respectively located on the series of sleepers, a layer of plywood on the steel strips, a series of floor boards in abutting parallel relation to each other, extending transversely to the steel strips, and located on the plywood layer, and a plurality of fasteners extending through the floor boards, through the plywood layer, and through the steel strips.

Other features and advantages of the invention will become apparent to those skilled in the art upon review of the following detailed description, claims, and drawings.

THE DRAWINGS

Figure 1:
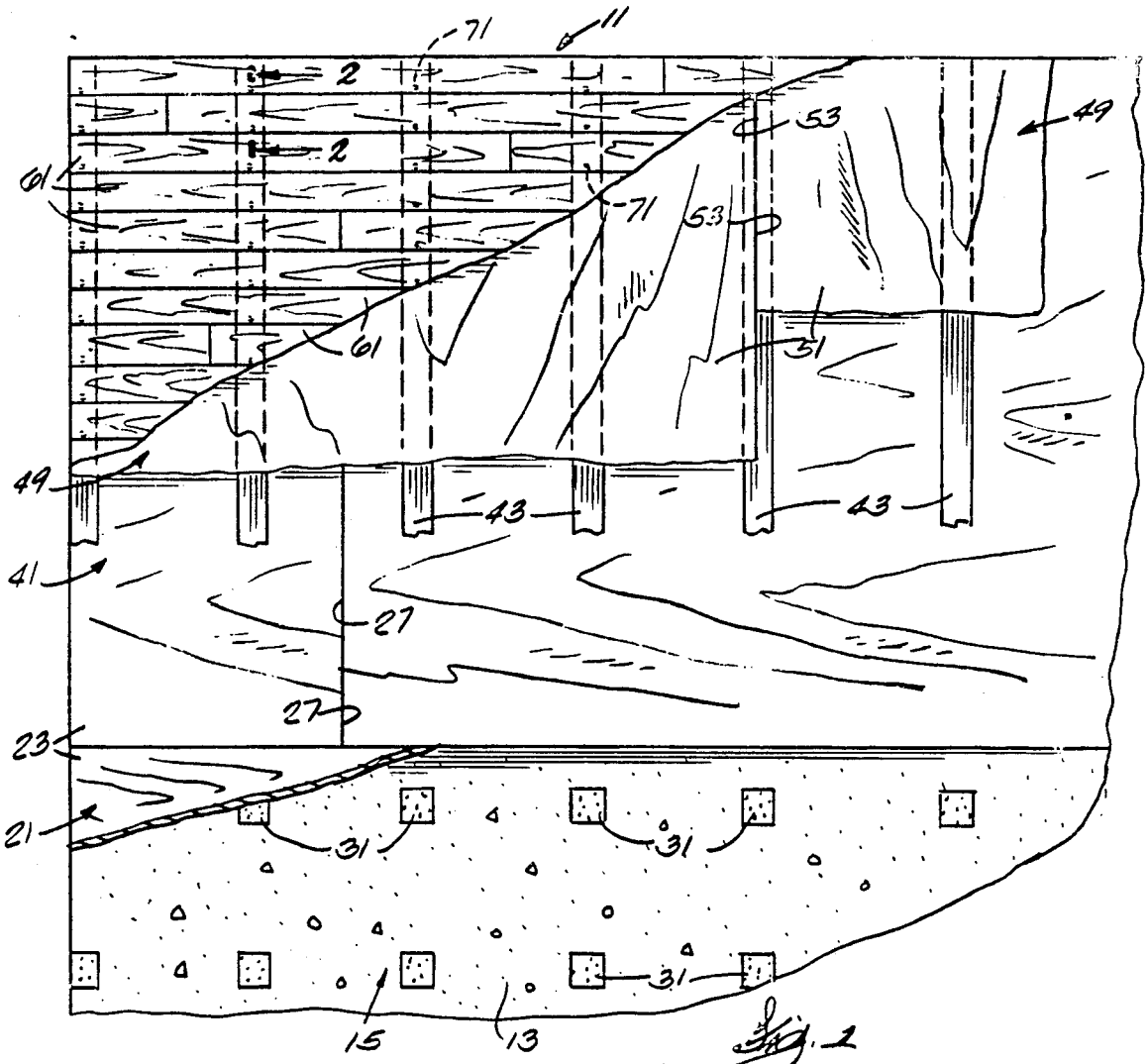
FIG. 1 is a fragmentary, plan view of a flooring system embodying various features of the invention.
Figure 3:
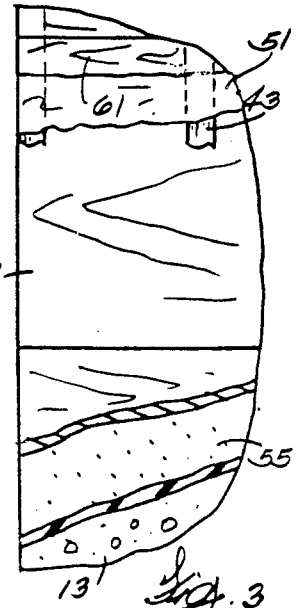
FIG. 3 is a partial, fragmentary plan view of an alternative to the flooring system shown in FIG. 1, using a resilient layer in place of resilient pads.
Figure 2:
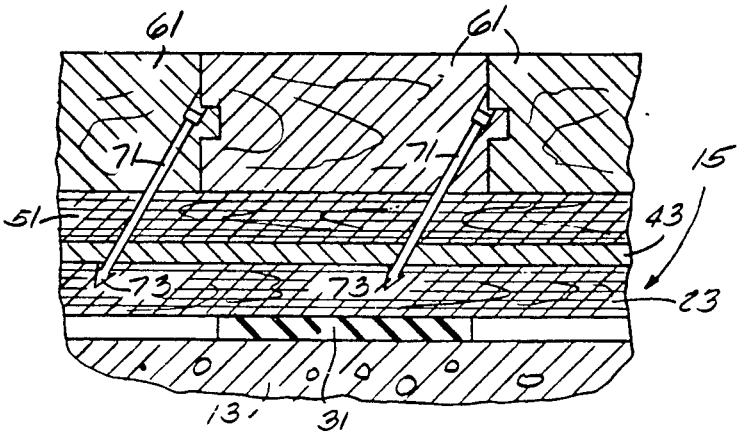
FIG. 2 is a cross-sectional view of the flooring system shown in FIG. 1 taken along line 2—2 thereof.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 of the drawings is a flooring system 11 which is adapted to be laid on a rigid supporting surface or slab 13 formed of concrete or other like material.

The flooring system includes an understructure 15 which rests on the supporting slab 13 and which includes a first layer 21 of plywood or other similar material located adjacent the slab 13 and comprises of a series of rectangular plywood panels 23 which preferably are approximately ½ inch thick and 4 feet wide by 8 feet long, and which are laid in strips and with end-to-end joints 27 of one strip staggered with respect to the end joints of the next strip, and with the strips extending in the long dimension of the slab 13.

The understructure 15 also includes a resilient underlayment or member in the form of a plurality of resilient pads 31 which are preferably of natural rubber which are located between the slab 13 and the first layer 21 of plywood and which are preferably rectangular in shape, i.e., for example, are approximately 2¼ inches by 3 inches long, and ⅜ inches thick, and which are laid in co-planar first and second series of strips, with the pads 31 in each strip being spaced apart from center to center at about one foot, and with the strips of the first series extending at a right angle to the strips of the second series, and with the strips spaced apart at about one foot from center to center.

The pads 31 are preferably fabricated of natural rubber although other materials can be employed and are preferably fastened to the undersurface of the plywood layer 21 by any suitable means, such as by stapling. In the assembled flooring system, the undersurface of the pads 31 rests on the slab 13.

Alternatively, if desired, and particularly when the slab 13 is somewhat uneven, the first plywood layer 21 can be laid on an underlayment in the form of a resilient layer 55 provided by, for example, a ½ inch thick layer of closed cell foam. Other materials can also be employed. Preferably the layer is formed by unrolling roles of the resilient material until the entire area of the slab 13 is covered. Preferably the rolls extend across the short dimensions of the slab 13. The resilient layer 55 can either be fixed to the first plywood layer 21, as by stapling or otherwise, or the resilient layer and plywood layer 21 can be merely in supporting engagement.

Freely supported on the top surface of the underlayment, i.e., on the top surface of the first plywood layer 21, and cushioned thereby, is a floating floor assembly 41 comprising a plurality of elongated metal straps or strips 43 which extend in spaced parallel relation to one another. Preferably, the metal strips 43 are of thirty gauge steel which is about three inches wide, which can be of any suitable length, and which are laid end-to-end to form strips which are spaced apart at twelve inches from center to center.

The floating floor assembly 41 also includes a second layer of plywood 49 which can be of any suitable thickness, which is formed by respective plywood panels 51 which preferably are ½ inch thick and 4 feet wide by 8 feet long, and which are laid with end-to-end joints 53 to form adjacent strips, with the end-to-end joints 53 of one strip being staggered with respect to the joints in adjacent strips.

Preferably, the strips in the second plywood layer 49 are laid at a substantial angle to the strips of the first plywood layer 21, i.e., at an angle between about 45° and about 90°.

The floating floor assembly 41 also includes a plurality of floor boards 61 which are laid in end-to-end strips extending in parallel and abutting engagement with each other. Any suitable floor boards 61 including tongue and groove hardwood boards can be employed. The floor board strips extend transversely to the metal strips 43 and preferably at about a right angle to the metal strips 43.

The floating floor assembly 41 also includes fastening means which extends through the floor boards 61, through the second plywood layer 49, and through the metal strips 43. While other specific constructions can be employed, in the disclosed construction, such fastening means comprises a plurality of nails 71, preferably two inch cleats having barbed ends 73, i.e., ends having a dimension greater than the dimension of the adjacent portion of the nail or cleat extending in the other direction from the ends 73. Preferably, each of the floor boards 61 is fastened by a nail 71 to each of the metal strips 43 located in underlying relation to each such floor board 61. In use, the barbed ends 73 extend beyond or below the metal strips 43 (somewhat into the underlying understructure) and, in response to natural force on the nails 71, are clinched by the metal strips 43 and serve to prevent withdrawal of the nails 71 from the metal strips 43 and therefore to securely fasten together the floating floor assembly 41, and to provide the floor assembly 41 and the flooring system 11 with increased stability as compared to prior flooring systems.

Figure 4:
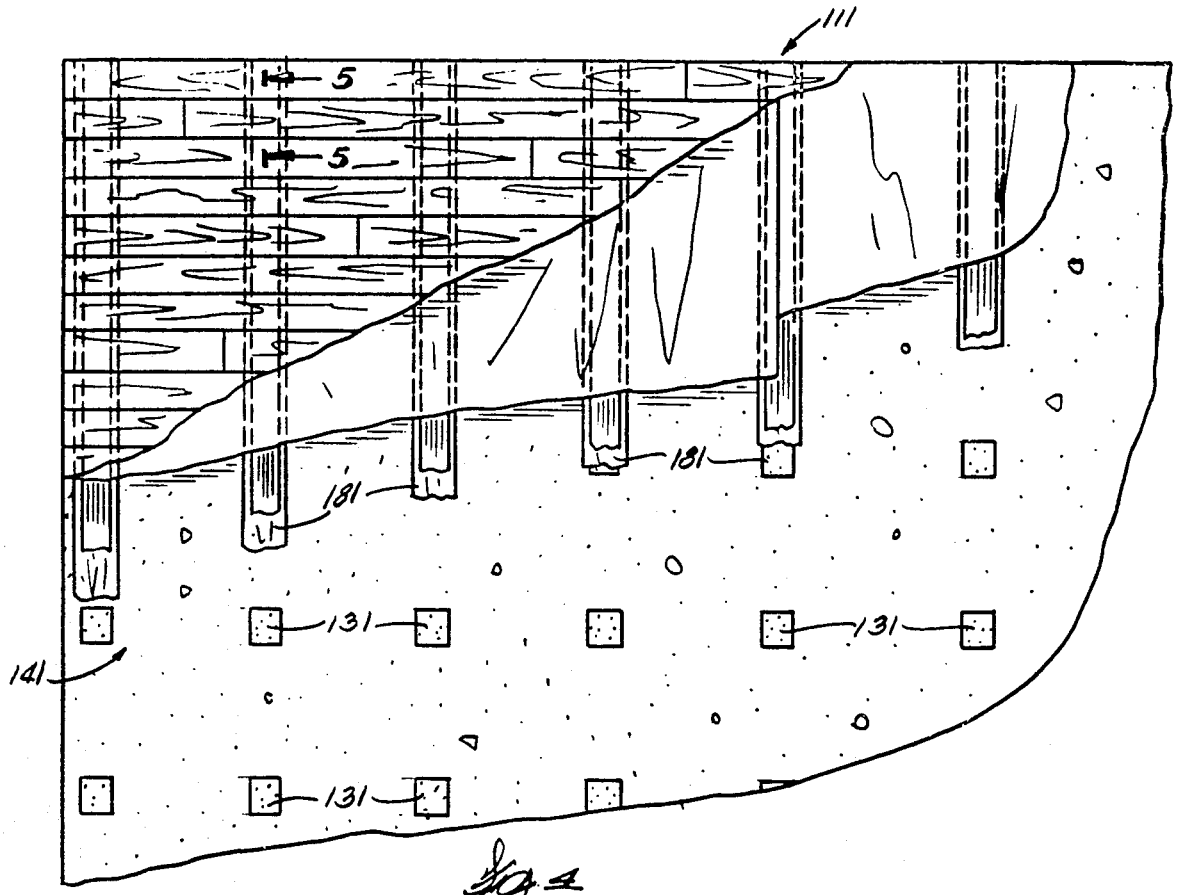
FIG. 4 is a fragmentary, plan view of an alternative embodiment of the flooring system shown in FIG. 1, using sleepers in place of plywood panels.
Figure 6:
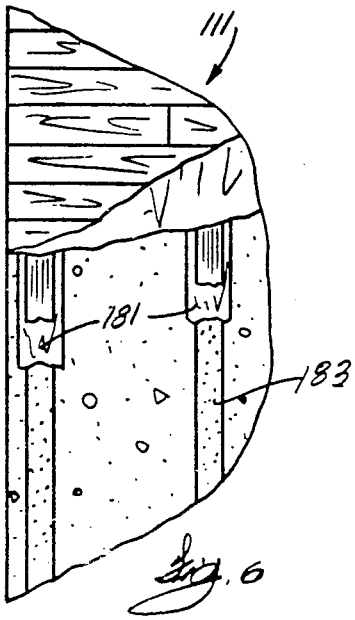
FIG. 6 is a partial, fragmentary plan view of an alternative to the flooring system shown in FIG. 4, using resilient members in place of resilient pads.
Figure 5:
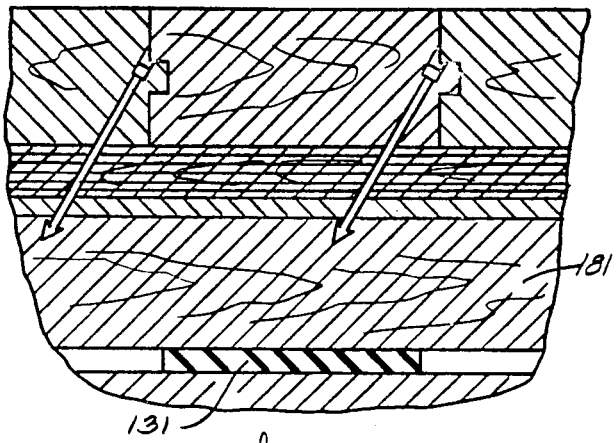
FIG. 5 is a cross-sectional view of the flooring system shown in FIG. 4 taken along line 5—5 thereof.

Shown in FIG. 4 is another flooring system 111 which, in part, is similar to the flooring system 11 shown in FIG. 1. More specifically, the flooring system 111 shown in FIG. 4 includes a floating floor assembly 141 which is generally identical to the floating floor assembly 41 of the flooring system 11 shown in FIG. 1. The flooring system 111 shown in FIG. 4 differs from the flooring system 11 shown in FIG. 1 in that the understructure is somewhat different, i.e., in that the first plywood layer 21 referred to in the flooring system 11 shown in FIG. 1 is omitted and in that the floating floor assembly 141 is supported on an understructure including a series of parallel sleepers 181 which engage but are not fastened to the undersurface of the floating floor assembly 141. Preferably, the sleepers 181 are two inches by three inches by four foot boards cut from soft wood, such as pine. The sleepers 181 are preferably treated with a wood preservative which retards fungus and insect attack and thereby increases the life span of the wood.

The sleepers 181 are laid end-to-end to form strips which extend in the short direction of the slab 13 and which are spaced apart on twelve inch centers. The end-to-end joints of the sleeper strips are staggered from one strip to the next.

Fixed to the bottom surface of the sleepers 181 by any suitable means, such as by staples, is a resilient member which preferably is in the form of a plurality of resilient pads 131 which are similar to the pads 31 referred to in connection with the flooring system 11 shown in FIG. 1 and which are preferably fastened to the undersurface of the sleepers 181 at one foot centers. If desired the resilient member can be in the form of a strip 183 of resilient material under each sleeper 181.

Various of the features of the invention are set forth in the following claims.

I claim:

1. A flooring system adapted to be laid on a rigid supporting slab, said system comprising an understructure resting on the supporting slab, and a floating floor assembly comprising a series of parallel and spaced apart steel strips resting on said understructure, a layer of plywood on said steel strips, a series of floor boards in abutting parallel relation to each other, extending transversely to said steel strips, and located on said plywood layer, and a plurality of fasteners extending through said floor boards, through said plywood layer, and through said steel strips.

2. A flooring system in accordance with claim 1 wherein said plywood layer is formed of a plurality of rectangular plywood panels laid with end-to-end joints to form adjacent strips and with the end-to-end joints in one of said strips of said plywood layer being staggered with respect to said end-to-end joints in adjacent strips of said plywood layer.

3. A flooring system in accordance with claim 2 wherein said floor boards extend at about a right angle to said metal strips.

4. A flooring system in accordance with claim 1 wherein said fasteners include barbed ends located below said undersurface of said metal strips.

5. A flooring system in accordance with claim 1 wherein each of said floor boards is fastened to each of said metal strips located in underlying relation thereto.

6. A flooring system adapted to be laid on a rigid supporting slab, said system comprising a first layer of plywood in adjacent relation to the supporting slab, a series of parallel and spaced apart steel strips on said first plywood layer, a second layer of plywood on said steel strips, a series of floor boards in abutting parallel relation to each other, extending transversely to said steel strips, and located on said second plywood layer, and a plurality of fasteners extending through said floor boards, through said second plywood layer, and through said steel strips.

7. A flooring system in accordance with claim 6 wherein said system also includes a resilient member between said first plywood layer and said slab.

8. A flooring system in accordance with claim 7 wherein said resilient member comprises a plurality of pads fastened to said first plywood layer in first and second series of parallel strips with the pads in each strip being spaced from one another and with said first series of strips extending at a right angle with respect to said second series of strips.

9. A flooring system in accordance with claim 7 wherein said resilient member comprises a layer of resilient material.

10. A flooring system in accordance with claim 6 wherein said second plywood layer is formed of a plurality of rectangular plywood panels laid with end-to-end joints to form adjacent strips and with the end-to-end joints in one of said strips of said second plywood layer being staggered with respect to said end-to-end joints in adjacent strips of said second plywood layer.

11. A flooring system in accordance with claim 10 wherein said first plywood layer is formed of a plurality of rectangular plywood panels laid with end-to-end joints to form adjacent strips, and with said end-to-end joints in one of said strips of said first plywood layer being staggered with respect to the end-to-end joints in adjacent strips of said first plywood layer, and wherein said strips of said first plywood layer extend at an angle within the range of about 45° to about 90° to said strips of said second plywood layer.

12. A flooring system in accordance with claim 10 wherein said floor boards extend at about a right angle to said metal strips.

13. A flooring system in accordance with claim 6 wherein said fasteners include barbed ends located below said undersurface of said metal strips.

14. A flooring system in accordance with claim 6 wherein each of said floor boards is fastened to each of said metal strips located in underlying relation thereto.

15. A flooring system adapted to be laid on a rigid supporting slab, said system comprising a series of sleepers in parallel spaced relation to one another and in adjacent relation to the supporting slab, a like series of parallel and spaced apart steel strips respectively located on said series of sleepers, a layer of plywood on said steel strips, a series of floor boards in abutting parallel relation to each other, extending transversely to said steel strips, and located on said plywood layer, and a plurality of fasteners extending through said floor boards, through said plywood layer, and through said steel strips.

16. A flooring system in accordance with claim 15 wherein said system also includes a resilient member between said sleepers and said slab.

17. A flooring system in accordance with claim 16 wherein said resilient member comprises a plurality of pads fastened to said sleeper in spaced relation to each other.

18. A flooring system in accordance with claim 16 wherein said resilient member comprises a strip of resilient material.

19. A flooring system in accordance with claim 15 wherein said plywood layer is formed of a plurality of rectangular plywood panels laid with end-to-end joints to form adjacent strips and with the end-to-end joints in one of said strips of said second plywood layer being staggered with respect to said end-to-end joints in adjacent strips of said second plywood layer.

20. A flooring system in accordance with claim 15 wherein said floor boards extend at about a right angle to said metal strips.

21. A flooring system in accordance with claim 15 wherein said fasteners include barbed ends located below said undersurface of said metal strips.

22. A flooring system in accordance with claim 15 wherein each of said floor boards is fastened to each of said metal strips located in underlying relation thereto.

* * * * *